United States Patent [19]

Mackles

[11] 4,342,522

[45] Aug. 3, 1982

[54] ROLL-ON DISPENSER WITH A FLEXIBLE MEMBRANE

[75] Inventor: Leonard Mackles, New York, N.Y.

[73] Assignee: Bristol-Myers Company, New York, N.Y.

[21] Appl. No.: 207,591

[22] Filed: Nov. 17, 1980

Related U.S. Application Data

[62] Division of Ser. No. 776,459, Mar. 10, 1977, abandoned.

[51] Int. Cl.[3] ..... A45D 33/12; B43M 11/02

[52] U.S. Cl. ..... 401/214; 401/145; 401/200; 401/216; 401/220

[58] Field of Search ..... 222/189; 401/145, 184, 401/200, 214–216, 219, 220

[56] References Cited

U.S. PATENT DOCUMENTS

| | | | |
|---|---|---|---|
| 361,098 | 4/1887 | Thorpe | 401/263 |
| 396,860 | 1/1889 | Coston . | |
| 554,189 | 2/1896 | Kochendarfer . | |
| 632,891 | 9/1899 | Burnett | 401/220 |
| 659,109 | 10/1900 | Smith | 401/219 |
| 720,705 | 2/1903 | Burt | 401/215 |
| 1,830,860 | 11/1931 | Scoles . | |
| 2,122,580 | 7/1938 | Morris | 221/16 |
| 2,562,073 | 7/1951 | Vaughn | 15/131.1 |
| 2,613,382 | 10/1952 | Patterson | 401/214 |
| 2,622,257 | 12/1952 | Lemonds | 401/214 |
| 2,654,108 | 10/1953 | Scelsi | 15/132.7 |
| 2,664,581 | 1/1954 | Miller et al. | 15/131.1 |
| 2,749,566 | 6/1956 | Thomas | 15/132.7 |
| 2,823,403 | 2/1958 | Whitney | 15/132.7 |
| 2,937,392 | 5/1960 | Williams | 401/213 |
| 3,048,881 | 8/1962 | Ackerman | 15/572 |
| 3,087,189 | 4/1963 | Scanlon | 15/513 |
| 3,111,703 | 11/1963 | Kaufman | 15/572 |
| 3,162,176 | 12/1964 | Dombrow | 120/42.4 |
| 3,248,017 | 4/1966 | Allen | 222/189 |
| 3,308,993 | 3/1967 | Bruno | 222/189 |
| 3,682,558 | 8/1972 | Miller | 401/200 |
| 3,682,558 | 8/1972 | Miller | 401/200 |
| 3,807,881 | 4/1974 | Seidler | 401/175 |
| 3,947,137 | 3/1976 | Hori | 401/217 |
| 4,037,977 | 7/1977 | Ronai | 401/209 |

FOREIGN PATENT DOCUMENTS

| | | | |
|---|---|---|---|
| 592569 | 2/1960 | Canada | 402/200 |
| 70939 | 1/1916 | Fed. Rep. of Germany | 401/214 |
| 1411393 | 11/1968 | Fed. Rep. of Germany | 401/214 |
| 1525024 | 4/1968 | France | 401/216 |
| 12262 | of 1914 | United Kingdom | 401/212 |
| 521943 | 6/1940 | United Kingdom | 401/200 |
| 635692 | 4/1950 | United Kingdom | 401/219 |
| 710585 | 6/1954 | United Kingdom | 401/214 |
| 843315 | 8/1960 | United Kingdom | 401/213 |
| 844082 | 8/1960 | United Kingdom | 401/213 |

*Primary Examiner*—Clyde I. Coughenour

*Attorney, Agent, or Firm*—Irving Holtzman; George A. Mentis

[57] ABSTRACT

A roll-on dispenser having an applicator ball, which dispenser is provided with a porous membrane that coacts with the ball to regulate the dispension of controlled amounts of powders. The amounts of material dispensed is dependent upon the porosity of the membrane and the porosity of the membrane is dependent upon the degree of its deformation by the ball upon operation of the dispenser.

6 Claims, 4 Drawing Figures

ROLL-ON DISPENSER WITH A FLEXIBLE MEMBRANE

RELATED CASES

This application is a division of Application Ser. No. 776,459 filed Mar. 10, 1977, now abandoned.

BACKGROUND OF THE INVENTION

The present invention relates to dispensers and more particularly, to applicator ball type, roll-on dispensers for dispensing powders, such as deodorants, antiperspirants, talcs, and the like.

U.S. Pat. No. 2,749,566 discloses an applicator ball type, roll-on dispenser. The ball is rotatably supported in the open, dispensing end of the dispenser, so that as it is rotated on the skin of the user it picks up material to be dispensed from inside the container and deposits the material on the skin. However, when the dispenser is inverted, the material continues to be deposited on and around the ball, even if the dispenser is not being used. Thus, the excess material not applied to the skin is wasted or otherwise falls out of the dispenser. Therefore, the need exists for means to regulate material dispension, which means would allow dispension only when the ball is rolled against the user's skin and in relation to the pressure being applied to the ball.

An object of this invention is to provide a dispenser of this type with means for control of the amount of material being dispensed.

Another object of this invention is to provide a dispenser of this type which is particularly suited to dispensing powders.

SUMMARY OF THE INVENTION

In accordance with the present invention, these objects are achieved by providing a dispenser having an open end, an applicator disposed in the open end, means for rotatably supporting the applicator and limiting its inward movement into the container, which means contact an inner minor portion of the applicator, and an annular member surrounding an outer minor portion of the applicator to limit the outward movement of the applicator away from the open end of the container. A variably porous membrane of open celled foam or sponge material, interposed between the applicator and the portion of the container adapted to hold the material to be dispensed. The porosity of the membrane varies with the degree of its deformation. The means for rotatably supporting the applicator permits its inward movement against the membrane, whereby the applicator bears against and deforms the membrane when it is pressed inwardly to allow a controlled amount of material to be dispensed through the membrane.

The present invention will be more fully appreciated by reference to the following detailed description of a preferred embodiment thereof and by reference to the accompanying drawings.

DETAILED DESCRIPTION OF THE INVENTION

Figure 2:
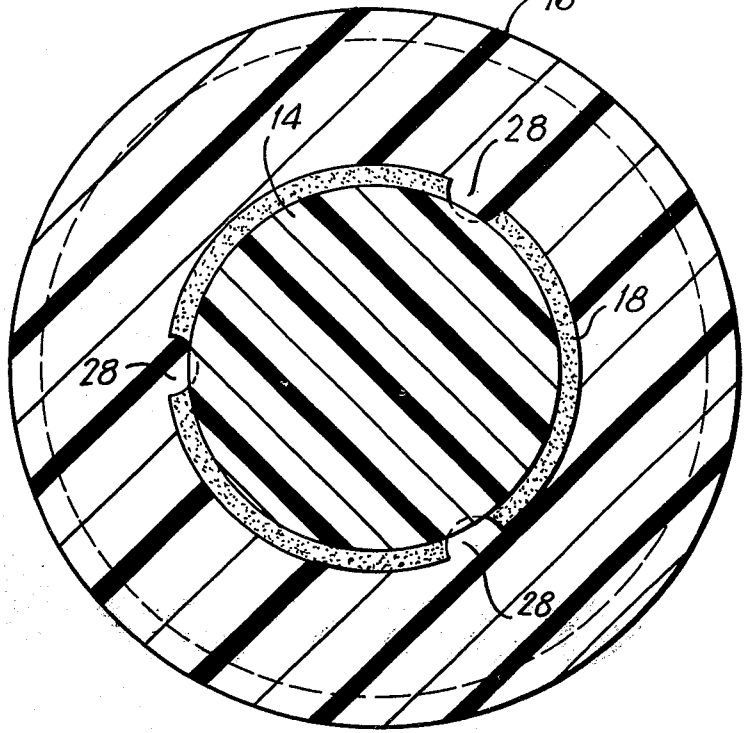
FIG. 2 is a sectional view taken along lines 2—2 of FIG. 1.
Figure 1:
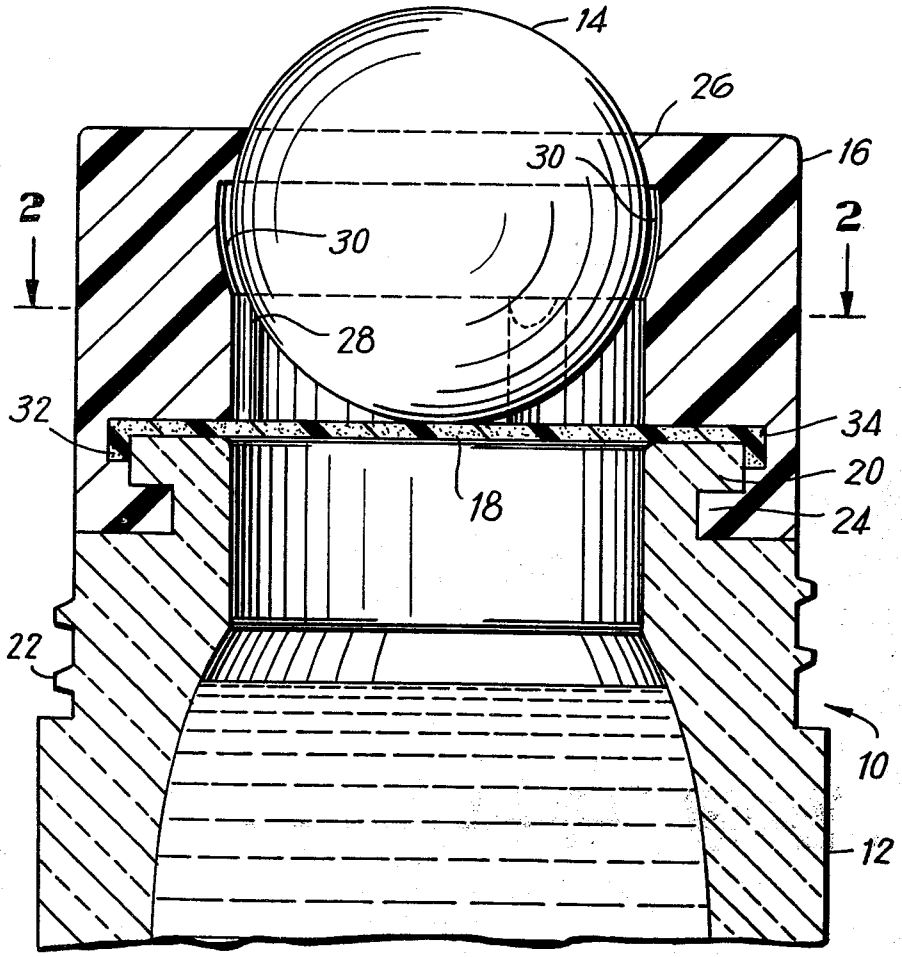
FIG. 1 is a partial, longitudinal sectional view of the dispensing end of a preferred embodiment of the dispenser of this invention.

Referring now to FIG. 1, reference numeral 10 indicates generally a dispenser, which includes a container 12, an applicator 14, and an annular applicator retaining ring 16. Container 12, typically formed of glass, styrene or the like, carries at its open end an outwardly extending flange 20 and external threads 22. Applicator 14 is preferably a round ball, but it may also be elliptical, cylindrical, or of any shape which will allow it to rotate in ring 16. For ease of description, it will hereinafter be referred to as a ball. Ring 16 is preferable formed of a relatively resilient material, such as polyethylene, and carries at its lower end an inwardly extending flange 24. Flange 24 engages flange 20 to secure ring 16 to the end of container 12. Ring 16 is provided at its upper end with an annular bearing portion 26, which surrounds an outer minor portion of ball 14 on which functions to retain ball 14 against movement outwardly from container 12. Ring 16 is further provided with three radially inwardly extending lugs 28 (best seen in FIG. 2) forming bearing surfaces, which engage an inner minor portion of ball 14 and which function to rotatably support ball 14 at the open end of container 12. Lugs 28 could also be molded directly to container 12. A portion of the inner surface of ring 16 is recessed to provide a reservoir space 30, which improves the dispensing action of dispenser 10. U.S. Pat. No. 2,749,566 discloses the device described in detail thus far, the disclosure of which patent is incorporated by reference herein.

Figure 3:
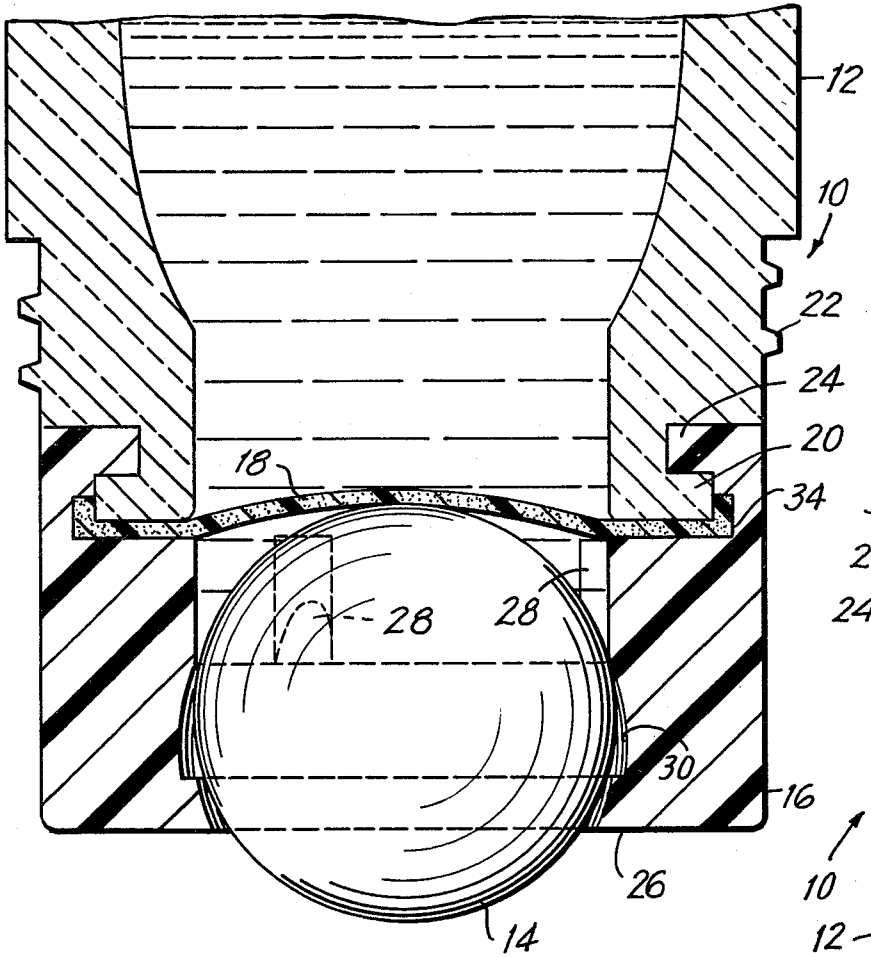
FIG. 3 is a partial, longitudinal sectional view similar to FIG. 1 but showing the dispenser in its inverted operation position and showing the deformation of the porous membrane of open celled foam or sponge material by the applicator ball.

The present invention contemplates the insertion of a variably porous membrane 18 between ball 14 and the portion of container 12 adapted to hold the material to be dispensed. To facilitate this insertion, membrane 18 is preferably provided with a bead 32 around its periphery which engages a groove 34 formed in ring 16. Bead 32, groove 34, and flange 20 cooperate to retain membrane 18 in the position shown in FIG. 1. Membrane 18 may be made from material which will have a relatively low porosity in its undeformed condition, as shown in FIG. 1, yet which will become relatively porous in its deformed (i.e. stretched and/or bent) condition, as shown in FIG. 3. One suitable class of available materials are those having an open cellular structure, such as open-celled foamed polyurethane, PVC, or rubber.

In such an open-celled foam or sponge membrane, where the membrane is in its undefined condition, the interconnecting pores offer a sufficient degree of friction or resistance to flow therethrough of the material to be dispensed to prevent an unintended dispension. When ball 14 presses upon and deforms the membrane, the resultant stretching thereof opens the pores sufficiently to permit a controlled flow of material through the membrane and out of the container, which depends upon the degree of deformation of the membrane.

Ball 14 has some freedom of movement in the inward direction (toward the inside of container 12 and against membrane 18) and, therefore, lugs 28 are designed to be deformable, either by being made of a very resilient material or by having as narrow a width as possible. Alternatively, lugs 28 can be recessed somewhat from ball 14 and the spring action of membrane 18 will perform the function of rotatably supporting ball 14, lugs 28 acting only as a limit stop.

To use the dispenser of the present invention, it is inverted, as shown in FIG. 3, so that the contents of container 12 flow against membrane 18. Initially, no substantial flow of material through membrane 18 occurs because the membrane is not deformed and, therefore, its holes or passages or pore are not open. However, when ball 14 is pressed inwardly against membrane 18 (as seen in FIG. 3), the passages of the membrane are opened and there is material flow through the membrane and into the spaces between ball 14 and ring 16, including reservoir 30. Should dispenser 10 now be righted and the pressure on ball 14 be removed, the material which has flowed through membrane 18 will remain above the membrane 18 and in contact with ball 14 because the passages through membrane 18 are closed. Ball 14 can therefore dispense some of the material upon rotation, since some material is retained in contact with ball 14. This action is particularly desirable when dispensing powder because without membrane 18, the powder would fall back into container 12 when the dispenser was righted.

Figure 4:
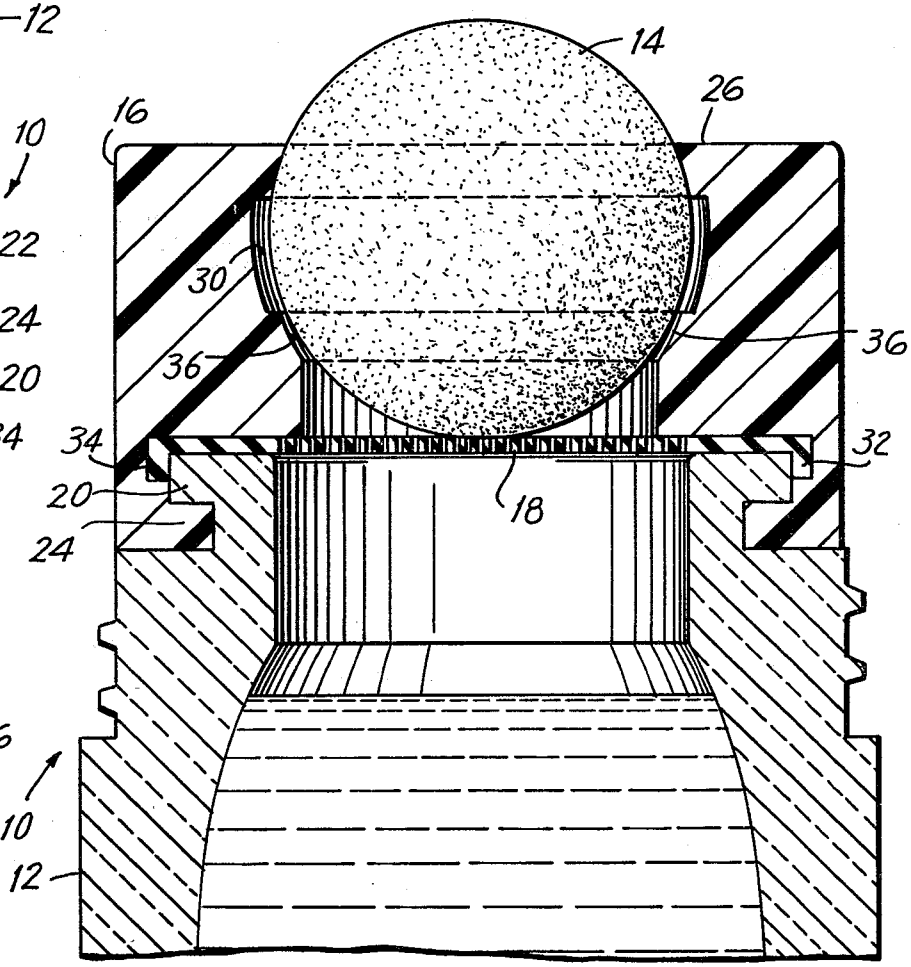
FIG. 4 is a partial, longitudinal sectional view of another preferred embodiment of a dispenser of this invention.

In another embodiment of the present invention shown in FIG. 4, lugs 28 are replaced with a continuous annular bearing surface or flange 36. In this embodiment, when dispenser 10 is inverted and ball 14 is pressed inwardly, the material to be dispensed from container 12 flows through membrane 18 and fills the spaces between membrane 18 and ball 14, but cannot fill reservoir 30 because ball 14 is pressed against flange 36. Release of pressure on ball 14 closes the passage through membrane 18 and allows material flow into reservoir 30. If ball 14 is now pressed inwardly again and rotated for dispensing, the only material available for dispensing is that material in reservoir 30, since ball 14 riding on flange 36 prevents further flow. Selection of the size of reservoir 30 will therefore allow selection of a controlled quantity of material to be dispensed for each cycle of no-pressure and pressure on ball 14.

The action of membrane 18 can be determined by several factors. Typically, a thickness of 0.005 to 0.50 is contemplated for the membrane when it is incorporated into a dispenser of the antiperspirant type, with 25 to 150 holes, passages or pores per linear inch. Naturally, the thickness of the membrane is inversely related to the amount of flow which will occur for a given amount of deformation. Membrane 18 can also perform a filtering function with respect to particle size, as well as acting as a moisture seal. Selection of membrane material and thickness will also affect the amount of pressure required to depress the applicator ball.

The surface of ball 14 may be textured to facilitate its dispensing function, as shown in FIG. 4. This texturing is particularly desirable when the material to be dispensed is a finely divided powder. Texturization may take the form of protuberances or indentations, such as ridges, bumps, grooves, dimples, waves and the like. The depth of such texturization as well as its frequence may be adjusted in conformity with the material to be dispensed.

While the invention has been described in specific embodiments thereof, it should be understood that it is not to be so limited for obvious modifications will occur to those skilled in the art without departing from the spirit and scope of the invention as set forth in the appended claims.

What is claimed is:

1. As an article of manufacture a dispenser adapted for dispensing powder comprising a container having powdered material disposed therein and further having an open end, an applicator disposed in the open end, supporting means for rotatably supporting the applicator and limiting its movement inward into the container, which means contact an inner minor portion of the applicator, and an annular member surrounding an outer minor portion of the applicator to limit the outward movement of the applicator away from the open end of the container; said supporting means comprising a plurality of spaced lugs, the spaces between the lugs permitting passage of material from the container when the applicator is in contact with the lugs, thereby enabling continuous dispensing of the material, a variably porous membrane of open-celled foam or sponge material interposed between the applicator and the portion of the container adapted to hold the material to be dispensed, the porosity of the membrane varying with the degree of its deformation, said membrane having from about 25 to about 150 holes per linear inch and is about 0.005 to about 0.50 inches thick; the means for rotatably supporting the applicator permitting its inward movement against the membrane, whereby the applicator bears against and deforms the membrane without blockage of the continuous flow of powder when it is pressed inwardly to allow a controlled amount of material to be dispensed through the membrane.

2. The article of claim 1 wherein the improvement further comprises a continuous annular flange, as the applicator supporting means, for contacting the applicator around its inner minor portion when the applicator is at the limit of its inward movement, the flange preventing passage of the material from the container when the applicator is in contact therewith, whereby only a

3. The article according to claim 1 wherein said membrane is open-celled foamed polyurethane.

4. The article according to claim 1 wherein said membrane is open-celled foamed PVC.

5. The article according to claim 1 wherein said membrane is open-celled foamed rubber.

6. An article of manufacture according to claim 1 in which said applicator has a textured surface whereby the dispensing of said powdered material is facilitated.

* * * * *

UNITED STATES PATENT AND TRADEMARK OFFICE

CERTIFICATE OF CORRECTION

PATENT NO. : 4,342,522

DATED : August 3, 1982

INVENTOR(S) : Leonard Mackles

It is certified that error appears in the above-identified patent and that said Letters Patent are hereby corrected as shown below:

Claim 2, line 47, after "whereby only a" insert the following

-- controlled amount of the material is available for release for each inward movement of the applicator. --

Signed and Sealed this

*Twenth-eighth* Day of *September 1982*

[SEAL]

*Attest:*

GERALD J. MOSSINGHOFF

*Attesting Officer*

*Commissioner of Patents and Trademarks*